US005715541A

United States Patent [19]

Landau

[11] Patent Number: 5,715,541

[45] Date of Patent: Feb. 10, 1998

[54] BRAIN AND SPINAL CORD PROTECTOR

[76] Inventor: William M. Landau, 4 Forest Ridge, Clayton, Mo. 63195

[21] Appl. No.: 786,476

[22] Filed: Jan. 21, 1997

[51] Int. Cl.[6] ..... A63B 71/10

[52] U.S. Cl. ..... 2/425; 2/2; 2/410

[58] Field of Search ..... 2/410, 455, 411, 2/421, 422, 425, 415, 44, 45; 602/17, 18, 19; 128/857, 869, 870, 874, 875

[56] References Cited

U.S. PATENT DOCUMENTS

| | | |
|---|---|---|
| 3,873,996 | 4/1975 | Varteressian . |
| 3,879,761 | 4/1975 | Bothwell . |
| 4,477,041 | 10/1984 | Dunne . |
| 4,541,421 | 9/1985 | Iversen et al. . |
| 4,638,510 | 1/1987 | Hubbard . |
| 4,765,317 | 8/1988 | Eastman et al. . |
| 4,999,855 | 3/1991 | Brown . |
| 5,123,408 | 6/1992 | Gaines . |
| 5,261,125 | 11/1993 | Cartwright et al. . |
| 5,272,770 | 12/1993 | Allen et al. . |
| 5,287,562 | 2/1994 | Rush, III . |
| 5,295,271 | 3/1994 | Butterfield et al. . |
| 5,313,670 | 5/1994 | Archer, III . |
| 5,347,894 | 9/1994 | Fischer . |
| 5,353,437 | 10/1994 | Field et al. ..... 2/425 |
| 5,371,905 | 12/1994 | Keim . |
| 5,444,870 | 8/1995 | Pinsen . |
| 5,517,699 | 5/1996 | Abraham, II . |

*Primary Examiner*—C. D. Crowder
*Assistant Examiner*—Larry D. Worrell, Jr.
*Attorney, Agent, or Firm*—Polster, Lieder, Woodruff & Lucchesi

[57] ABSTRACT

A brain and spinal cord protector is provided to protect the brain and spinal cord of a user against a fall. The protector comprises a jacket which is worn about the user's torso, a head shield shaped to cover the user's head, a support extending from the jacket to the head shield to position the head shield above the jacket so that the inner surface of the head shield is spaced from the user's head. This will allow the user to have full and free movement of his head relative to the head shield when wearing the head shield, and will prevent forces which impact the head shield from impacting the head, and will prevent compression and bending injuries to the neck, the forces of such impacts being transferred to the vest through the support.

23 Claims, 3 Drawing Sheets

BRAIN AND SPINAL CORD PROTECTOR

BACKGROUND OF THE INVENTION

This invention relates to a brain and spinal cord protector for use in high speed, high risk activities such as horseback riding, bicycling, motorcycling, skiing and roller-blading, for example. The device will protect against brain and spinal cord damage due to strong forces applied suddenly to the head in any direction, but especially downward and forward, such as, for example, when an individual is thrown forward from a motorcycle and lands on, or strikes, the top of his head, in which case, the force and momentum of the whole body pushes directly onto the neck and skull structures. The optimal device is light in weight, provides free functional movement of the head and neck, and provides a free wide visual field in all directions.

Acute trauma to the head may produce local damage to the skull and brain. Severe displacement of the head on the neck can also produce serious and often irreversible damage to the spinal cord. Most severe neck injuries are caused by strong downward forces applied to the top of the head, compressing the cervical spine downward and forward. Extreme flexion of the neck forward or backward (whiplash), less often sideways, also produces fracture dislocations that damage the spinal cord, especially at the base of the neck. In most normal voluntary activity, the head tips forward about 30° and backwards about 35° about an axis at the craniocervical junction in the upper neck. It is largely the upper neck that accomplishes easy lateral rotation, typically of about 75° to the left and right, for an overall rotation of about 150°. Lateral sideways flexion is seldom required beyond 15°.

The chest, including the rib cage and thoracic spine, is relatively inflexible. The upper portion of the chest is well padded by the bony shoulder girdle and the heavy muscles of the shoulders and the base of the neck. The broad upper trunk of the torso is much more capable of sustaining direct force trauma than the highly mobile, narrow cervical spine. Except for direct sharp trauma to the midline dorsal spine, the thoracic spinal cord is well protected by the shoulder musculature, vertebral bodies, and the rib cage. It follows that if traumatic forces applied to the head can be transmitted to the trunk or torso, the forces will impact the sturdy shoulders and rib cage, rather than the cervical spine. Injury (even major injury) to the shoulder girdle and rib cage is a favorable trade for irreparable damage to the nervous system.

The standard padded head helmet (such as worn by motorcyclists, bicyclists, rollerbladers, etc.) deflects and shields the cranium from impacts and distributes the force of the impact at the site of impact. However, the helmet provides no protection to the neck when traumatic force is applied from the front, back or side of the head. Force along the axis of the neck, such as when the subject is thrown and lands on the top of her head, is undiminished. The helmeted subject is still at high risk of compression and bending injuries to the cervical spine and spinal cord.

Several devices have been proposed to protect both the neck and head. The Archer (U.S. Pat. No. 5,313,670) and Rush (U.S. Pat. No. 5,287,562) devices provide emergency airbag support in response to extreme force changes, similar to the automobile airbag. Their structures are complicated, expensive, and require the subject to wear a heavy helmet that receives traumatic forces directly. The Dunne (U.S. Pat. No. 4,477,041) device is a neck protective adaptation for an ejection seat for airplane pilots.

Some devices are based upon a tight fitting helmet, which limits normal movements. Neck flexion and extension in these devices are limited by a fluid dampening mechanism (Keim, U.S. Pat. No. 5,371,905), by a flexible interlinked brace (Gaines, U.S. Pat. No. 5,123,408), by straps attached to the helmet and the shoulders (Allen, U.S. Pat. No. 5,272,770), or by a single articulated rod attached to the back (Varteressian, U.S. Pat. No. 3,873,996) or top (Cartwright et al., U.S. Pat. No. 5,261,125) of the helmet and the back of a body jacket. Another device, designed for the occupant of a high performance vehicle (Hubbard, U.S. Pat. No. 4,638,510), has a tethered helmet and a high collar attached to the shoulders to prevent neck bending. All of these devices fail to protect against a strong force applied to the skull vertex along the axis of the neck.

Several appliances designed particularly for contact sports provide massive enveloping coverage for the rostral or top end of the subject (i.e. the subject's head). The Abraham (U.S. Pat. No. 5,517,699) device has a hood which is connected to shoulder support equipment by a leaf spring, and a helmet within that, which has extensions that catch a support ring to prevent extreme bending movements of the neck. The visual field is highly limited by the spherical helmet. The Pinson (U.S. Pat. No. 5,444,870) football helmet and shoulder pad combination limits the movement of the head in any direction. The outer helmet is separated from the closely applied head helmet by springs. The Butterfield et al. (U.S. Pat. No. 5,295,271) shoulder rest helmet has a large enveloping space helmet connected on the shoulders. The subject wears a padded helmet inside. The Brown (U.S. Pat. No. 4,999,855) combination helmet and upper body protector provides a metal cage surrounding the head, based upon the shoulder structure and topped by a hemispherical hood. The subject wears a separate inside skull and chin protector. The Bothwell (U.S. Pat. No. 3,879,761) device provides a massive outer hood into which the head and inner helmet are fixed by "a ball and socket engagement". The user's visual field and spontaneous movement are greatly limited.

A therapeutic surgical appliance is available for preventing movement of the head and neck in order to allow for the severely injured cervical spine to heal. One such device is shown in U.S. Pat. No. 4,541,421 to Iversen et al. This appliance includes a metal halo which is secured to a patient's skull and has rods extending from the halo to a jacket. The appliance is designed to prevent movement of the head and neck in any direction. It is analogous to a east for a broken arm or leg. It is not designed to protect the head and neck from injury.

BRIEF SUMMARY OF THE INVENTION

The invention as set forth in the various claims below, has one or more of the following objects and features.

One object of this invention is to provide a new and improved brain and spinal cord protector which will protect a user's head, neck and cervical spine during a fall from a horse, motorcycle, etc.

A further object is to provide such a protector which will transmit forces from an impact on the user's head to the user's shoulders and rib cage.

An additional object is to provide such a protector which will not unduly limit the user's ability to move his head (either from side-to-side or forward and backward) while wearing the protector.

Moreover, another object is to provide such a protector which will not unduly limit the user's field of vision.

Another object is to provide such a protector which is comfortable.

These and other objects will become apparent to those skilled in the art upon review of the following disclosure in light of the drawings.

The following discussion provides a summary of the invention, and also comments about features of the preferred embodiments of the invention. In accordance with the invention, generally stated, a brain and spinal cord protector is provided to protect the head and neck of a user against a fall. The protector comprises a sleeveless jacket which is worn about the user's torso, a head shield shaped to cover the user's head, and rigid supports extending from the jacket to the head shield to position the head shield above the jacket so that the inner surface of the head shield is spaced from the user's head. This will allow the user to have full and free movement of his head relative to the head shield and will prevent forces which impact the head shield from impacting the head and from bending and compressing the neck and spinal column. The supports comprise posts which are mounted at one end to the jacket and at the second end to the head shield to substantially prevent movement of the head shield relative to the support.

The jacket comprises a vest made of a sturdy, pliable material and a yoke which covers a portion of the front and back of the vest and the shoulders of the vest. The yoke is made of a stiffer material which can withstand impacts and distribute the force of the impact to the user's shoulders and trunk. The material from which the yoke is made can be the same as, or different from, the material from which the vest portion of the jacket is made.

The head shield support comprises a back support which extends between the back of the head shield and the back portion of the yoke, and a from support which extends between the head shield and the yoke. The front support is positioned to be rearwardly of the user's eyes so that they will not substantially interfere with the user's field of view. The front support comprises a pair of front support posts which are mounted at one end to the yoke, and at the other end to the head shield. The jacket includes front bosses on the yoke which receive the bottom ends of the front support posts, and the head shield includes front mounting brackets which receive upper ends of the from support posts. The front support posts can extend generally vertically upwardly from a front portion of the yoke, or can extend diagonally forwardly from the shoulders of the yoke to the head shield. If the front support posts extend at an angle, the angle is preferably between 15° and 25° with the vertical when the user is standing or sitting upright. The back support comprises a pair of back support posts which extend generally vertically upwardly from the back of the yoke. The jacket includes a pair of rear bosses on the yoke which receive the bottom ends of the back support posts. The head shield includes a pair of rear mounting brackets which receive an upper end of the rear support posts.

The from and rear bosses on the yoke and the from and back mounting brackets on the head shield preferably comprise nylon balls which frictionally receive the support posts. The balls are contained in a housing, and the housing and bail together form a ball and socket type bracket which is adjustable and securable in a desired position. The position or angle of the posts can thus be set and then the posts can be secured in position using set screws.

The rear support, alternatively, can comprise a rear buttress which extends up from the yoke to be connected to the rear portion of the head shield. The head shield is preferably provided with a mounting ring on which the head shield brackets are mounted.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 2:
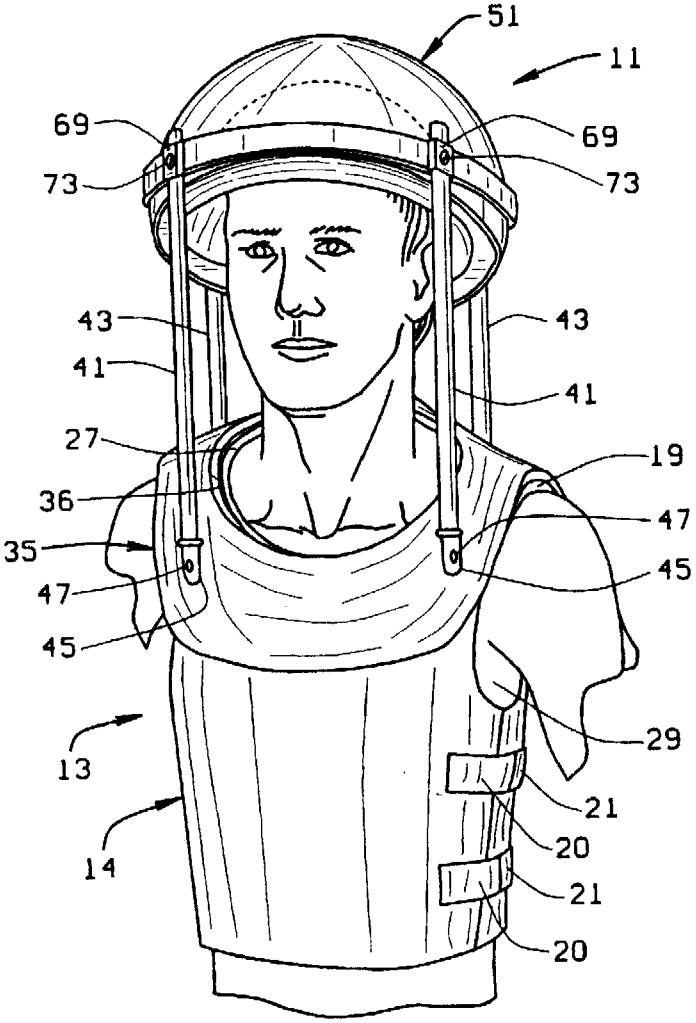
FIG. 2 is a front perspective view of the protector.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

A brain and spinal cord protector 11 of the present invention includes a jacket 13 which fits over the chest and shoulders of the user. The jacket 13 comprises a vest 14 and a yoke 35. The vest 14 is preferably made of a pliable material, such as a heavy vinyl or nylon, which is flexible and generally comfortable to wear. It is lightly padded on the inside, as at 16, to provide for more comfort. The vest 14, as shown, includes a front portion 15 and a back portion 17 which are joined by a shoulder portion 19. The back portion 17 extends around the sides of the user, beneath the user's arms to be joined to the front portion 15. The vest 14 has a strap 20 on the from portion 15 and a cooperating strap 21 on the back portion 17 which can be connected together to enable the jacket 13 to be secured about the user's torso. Preferably, there are two sets of cooperating straps 20 and 21 for each side of the jacket 13 (i.e., the fight side and left side of the jacket), one near the bottom of the vest 14, and one slightly beneath the user's arm. The cooperating straps 20 and 21 can be connectable to each other in any conventional manner. For example, the straps can be provided with a conventional seat belt buckle which will hold them together. The shoulder portion 19 has a head opening 27 sized to permit the user's head to pass therethrough. The shoulder portion 19, and front and back portions 15 and 17, cooperate to form arm holes 29.

As noted above, padding 30 is provided on the interior of the vest 14 to provide comfort to the user. The padding 30 can be made to be removable. Thus, a thin padding can be applied in warmer weather, when all that is required is to make the vest more comfortable. In the cooler months, thicker padding, such as fleece, can be used to add some warmth to the jacket. This also allows for the padding to be removed for washing.

A yoke 35 is formed at the upper portion of the jacket 13. The yoke 35 covers the shoulders 19 of the vest 14 and a portion of the front and back of the vest below the neck line. The yoke 35 has a head opening 36 co-extensive with the head opening 27 of the vest. The yoke 35 is made to be more rigid than the vest 14 so that the yoke 35 can withstand impact forces without shattering to distribute such forces to the user's shoulder girdle and rib cage, as described below. The yoke can be made of a hard plastic, fiber glass, or metal for example, and is more heavily padded than the vest 14. The yoke 35 is preferably a one-piece structure, but can be made of more than one piece if desired. As shown in the drawings, the yoke 35 is separate from the vest 14 and is permanently secured to the vest 14, such as by an adhesive or by welding. Alternatively, the yoke 35 can be made of a hard plastic which is co-molded with the vest 14, or of the same plastic as the vest to be molded with the vest. In either event, the yoke 35 is at least slightly flexible to facilitate donning and removal of the vest.

As can be appreciated, the jacket 13 is donned by placing one's head through the head opening 27 in the vest 14 and the opening 36 in the yoke 35 when the front and back portions are not joined by straps 20 and 21. The straps 20 and 21 then are connected together to join the front and back portions together to secure the jacket about the user.

Two front support posts 41 and two rear support posts 43 are mounted to the yoke 35 and extend upwardly, along a generally vertical plane from the yoke. The support posts 41 and 43 themselves, in the embodiment shown, extend generally vertically from the yoke 35. The support posts 41 and 43 are made of a structurally strong, rigid material, such as graphite, metal, or any other structural material which will serve to transfer forces, as will be described below. Preferably, the support posts 41 and 43 are cylindrical and about one centimeter in diameter. Other shapes and sized could of course be chosen for the posts 41 and 43, as long as they are sufficiently strong to withstand the compression and bending forces which can be imposed upon them during a fall.

The yoke 35 includes front bosses 45 and rear bosses 46 which are preferably integrally molded with the yoke 35. The bosses 45 and 46 have recesses which telescopically and snugly receive the bottom ends of the support posts 41 and 43, respectively. The posts 41 and 43 are secured in the bosses 45 and 46 by use of set screws 47 which pass through the bosses to bear against the lower ends of the post. The posts 41 and 43 can also be secured in the bosses 45 and 46 by any other conventional means, such as by gluing or welding. The posts 41 and 43, alternatively, can be threaded to screw into the recesses of the bosses 45 and 46, and/or secured with pins, such as cotter pins, which pass through the bosses and the support posts. Preferably, the angle of the posts relative to the bosses can be adjusted and set in a desired position, as is discussed below.

Figure 1:
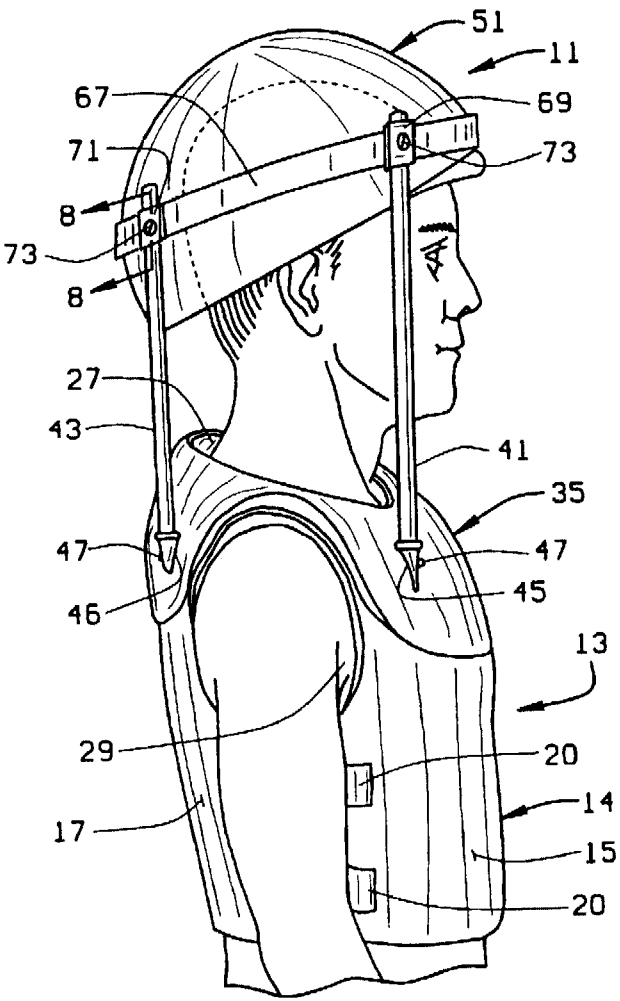
FIG. 1 is a side elevational view of one illustrative embodiment of a brain and spinal cord protector of the present invention when being worn by a user.
Figure 4:
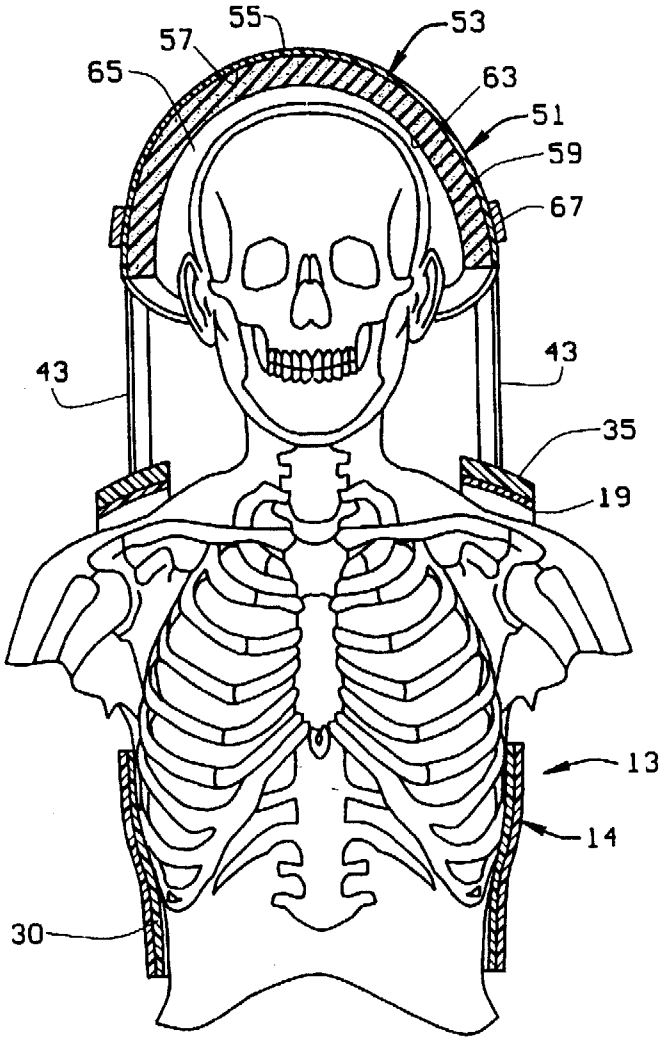
FIG. 4 is a transverse cross-sectional view of the protector when worn.
Figure 3:
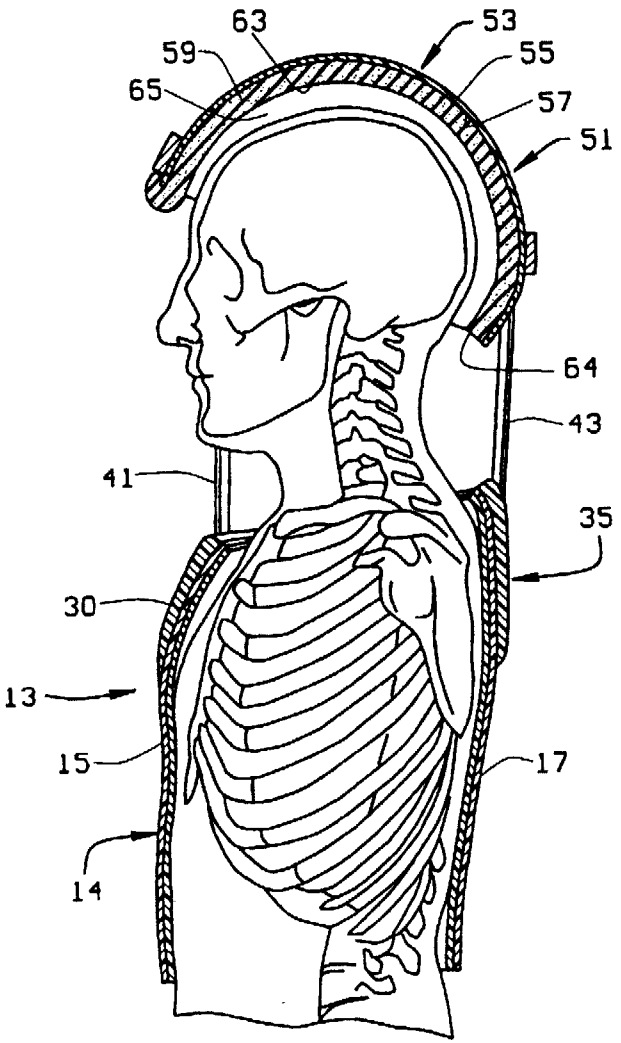
FIG. 3 is a lateral cross-sectional view of the protector when worn.

A hard plastic head shield 51 is secured to the tops of the support posts 41 and 43. The head shield 51 comprises a shell 53 made of hard, rigid, impact resistant material, such as a hard plastic or fiber glass, for example. The shell 53 has an outer surface 55 and an inner surface 57. The head shield 51 also comprises a layer of padding 59 which is mounted to the inner surface 57 of the shell 53, such as by adhesive, for example. The head shield 51 is preferably generally hemispherical in shape, as seen in FIGS. 1 and 2, and covers a portion of the user's forehead, the sides of the user's head above the ears, and the back of his head. Other shapes could be used which cover slightly more of the head, as desired.

The support posts 41 and 43 provide a rigid support for the head shield 51 and are sized such that the inner surface 63 of the padding 59 is about two centimeters above the cranial surface. Thus, a space 65 exists between the user's head and the padding 59. The lower edge of the head shield is heavily padded around its margin, as at 64. The padding 59 may also wrap around the edge of the shell 53 in the front of the shell 53 to reduce the force of contact between the user's forehead and the forward edge of the shell in a fall. Because the head shield 51 is spaced above the user's head, the shield 51 will not interfere with movement of the user's head. Thus, the user can turn his head relative to the shield 51. Further, the user can also tilt his head forward and backward. The space 65 can be more or less than the two centimeters noted, and can vary according to the size and shape of a user's head. The space 65 is sized such that the user can freely move his or her head inside of the head shield 51 without significant interference from the head shield 51, yet in a fall, the head shield 51 will prevent the head from moving too far forward or backward to substantially prevent whiplash type or flexion related injuries to the neck and spinal cord.

A mounting ring 67 is fixed to the outer surface 55 of the head shield shell 53. The mounting ring 67 can, for example, be made of a rigid plastic or light metal, and can be adhesively secured or welded to the shell 53, or formed integrally with the shell 53. Front and back mounting brackets 69 and 71 are formed on or fixed to the ring 67 to enable the head shield 51 to be mounted on the posts 41 and 43 such that the head shield 51 cannot move relative to the posts 41 and 43. The brackets 69 and 71 can be made of plastic or metal, and can be integrally formed with, or welded to, the mounting ring 67. The tops of the posts 41 and 43 are secured in the brackets by fasteners 73, so that the head shield will not slide relative to the support posts, even when strong axial forces are applied to the head shield. The fasteners 73 are illustrated to be set screws, but alternatively could be pins or screws which extend through the posts and the brackets, for example. Other conventional means of securing the support posts 41 and 43 in the head shield brackets 69 and 71 can be used. The posts 41 and 43 may, for example, be glued or welded in the brackets 69 and 71.

Figure 8:
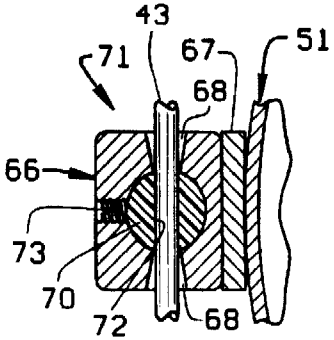
FIG. 8 is a cross-sectional view of a ball-and-socket bracket which receives support rods of the protector to support a head-shield of the protector above a user's skull.

The brackets 69 and 71 preferably comprise a bracket having a ball-and-socket type configuration, such as shown in FIG. 8. The bracket comprises a body 66 which has aligned top and bottom openings 68. A ball 70 is encased within the body to be pivotal and rotatable within the body in three dimensions. The ball 70 includes a bore 72 which extends therethrough and is sized to frictionally grip the top of a support the post. The ball bore 72 can be aligned with the top and bottom openings 68 of the bracket body 66 to pass the tops of the posts therethrough. The ball 70 is made of a pliable material such as hard nylon which will frictionally grip the post which is inserted in the ball bore. The set screw 73 extends through a screw hole in the body sufficiently far to be at least slightly imbedded in the ball. The screw 73 will secure the ball 70 in the desired position within in the body and will act to compress the ball to increase the frictional grip of the ball on the post. The ball thus has a strong grip on the post which is very difficult to overcome and substantially prevents the head shield 51 from moving relative to the posts 41 and 43. Such a ball-and-socket joint is shown, for example, in U.S. Pat. No. 4,541,421, which is incorporated herein by reference. This ball-and-socket joint type bracket will allow for the post to be angled differently for different users. That is, a single setting for the post may not work properly for all users. It is thus desirable to allow for some pivoting of the post relative to the bracket while the user is being fitted for the protector. The ball-and-socket joint bracket will allow this. Once the post is properly set, the post is fixed in place so that it cannot move relative to the head shield. Other configurations can also be used. For example, the bore through the ball could be internally threaded so that the support post can be screwed into the ball. Alternately, the bracket may be one which has a slightly oversized bore extending therethrough, and which accepts a wedge to properly align the post. Alternatively, multiple set screws can be used with the oversized bore. The set screws can be placed at two or more locations around the bracket so that they can then be used to properly align the post. The same ball-and-socket type bracket may be used for the front and rear bosses of the vest. However, for the vest, the bracket body will be provided with only one hole through which the post extends.

As seen in FIG. 1, the yoke rear bosses 46 and the head shield rear mounting brackets 71 are generally vertically aligned, so that the rear support posts 43 will extend generally vertically from the yoke 35. The yoke rear bosses 46 are thus mounted to the rear of the yoke to be positioned slightly above the user's armpit, so that they extend upwardly behind the user's ears. The front bosses 45 and head shield front mounting brackets 69 similarly are generally vertically aligned such that the front support posts 41 extend generally vertically from the yoke 35. The front bosses 45 are approximately on the same horizontal plane as the rear bosses 46, and are positioned to be slightly above the user's arm pits. The front support posts 41 are thus positioned to be between the user's eyes and ears, as seen in FIG. 1. The front posts 41 are positioned to be outside of the user's field of view, when the user is looking straight ahead. The posts 41 will come into the user's field of view as he turns his head, however, the small diameter of the support posts 41 minimizes any obstruction to the field of view.

The size of the space 65 between the user's head and the head shield 51 at the lower rear end of the shield 51 stops dorsiflexion (rearward tilting) of the head at about 40°, the forward portion of the head shield padding 59 (the brow portion of the pad 59) permits forward flexion of about 30°. Likewise, the shield 51 is broad enough to permit comfortable rotation of the head about 70° from side to side. Thus the user has free, voluntary, and substantially full movement of the head in all planes.

In use, if the user falls and lands on his head, the forces of the impact will be spread across the head shield 51, through the support posts 41 and 43, and transmitted to the yoke 35 of the jacket 13. The posts 41 and 43 are secured in the brackets 69 and 71 sufficiently tightly to prevent the head shield from moving axially relative to the support posts 41 and 43, even when a substantially strong impact is applied to the head shield 51. Because the user's head is not in contact with the head shield 51, substantially no axial forces will be applied to the head, thus substantially preventing compression of the spine. All such forces will be transmitted to the yoke 35 of the jacket 13 and hence, to the shoulder girdle of the user, where such forces will cause less severe trauma to the user. Thus, the protector 11 provides direct protection against axial force distortion of the head and neck. Further, the padded inner edges of the head shield prevent injurious fore, aft and sideways bending movements to the head and neck. The space 65 between the head shield and the head is sized so that that the head shield will protect the user's head from direct impacts with sharp edged objects, and also prevent over-extension or flexion of the neck during a fall. On the other hand, the space 65 is sized to allow substantially free movement of the head from side to side and up and down. Although the space 65 is preferably about 2 cm, it can be smaller or larger than 2 cm depending upon the size and shape of the user's head.

Figure 7:
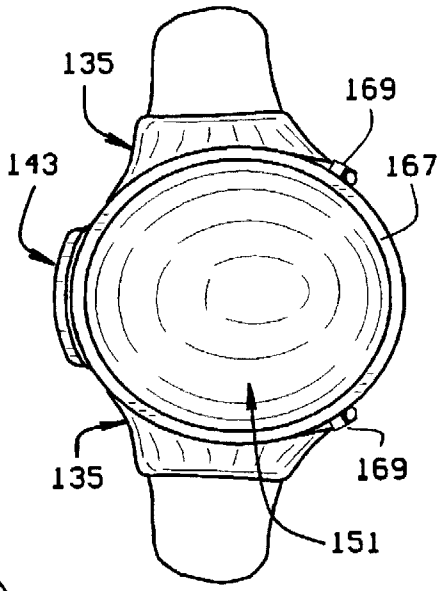
FIG. 7 is a top plan view of the brain and spinal cord protector & FIG. 5.
Figure 6:
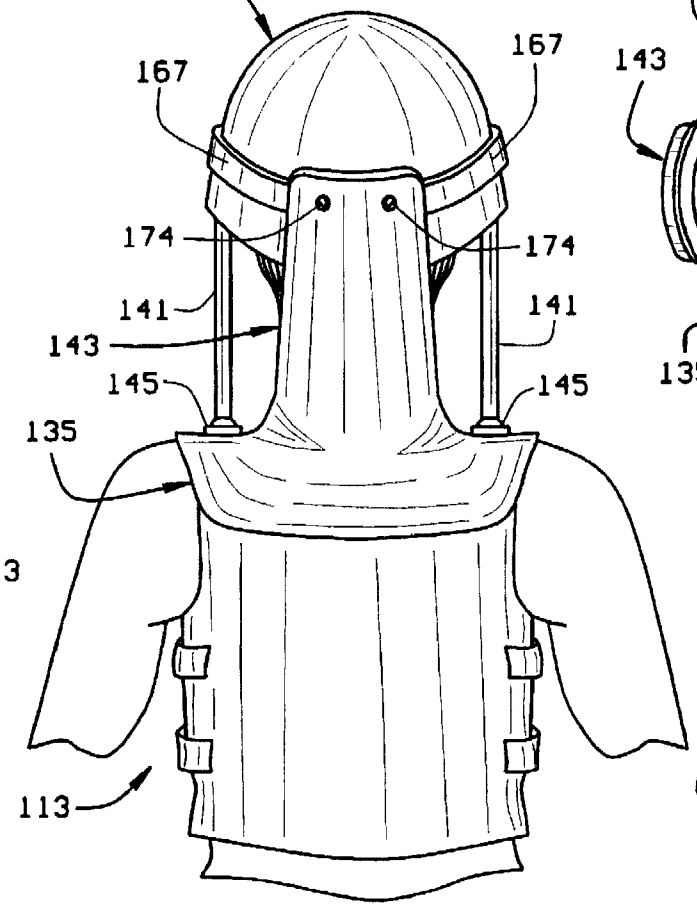
FIG. 6 is a rear elevational view of the brain and spinal cord protector of FIG. 5.
Figure 5:
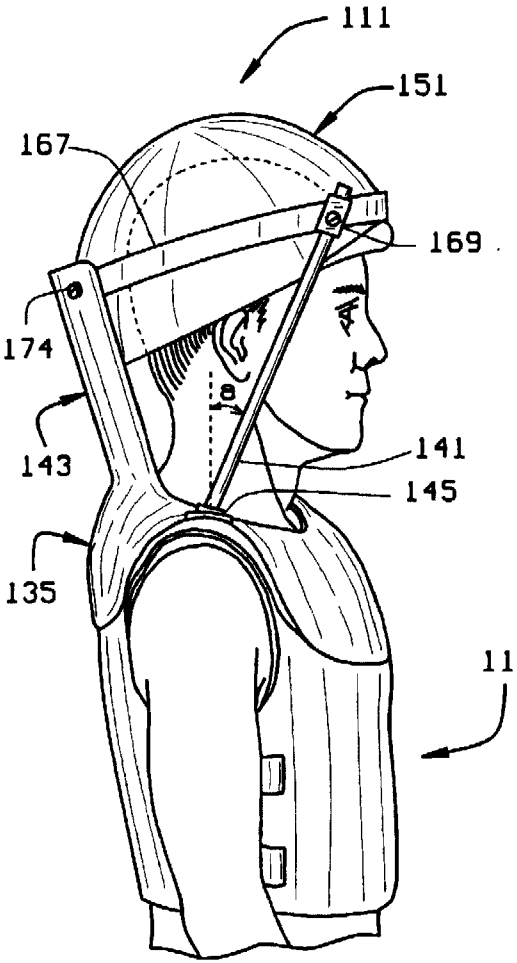
FIG. 5 is a side elevational view of an alternative embodiment of the protector.

An alternate embodiment of the protector is shown in FIGS. 5–7. The protector 111 provides an alternative placement for the front support posts 141 and provides an alternative rear support 143. The jacket 113 and head shield 151, are substantially identical to the jacket 13 and head shield 51, shown in FIGS. 1–4. In the protector 111, the front bosses 145, which receive the bottom ends of the front support posts 141, are positioned generally on top of the shoulder. The head shield front mounting brackets 169 are mounted in the same place as the front mounting brackets 69, of the embodiment shown in FIGS. 1–4. Thus, the front support posts 141 extend diagonally rearwardly from the head shield 151. This positions the front support posts 141 out of the user's field of view, even when his head is turned. Further, the rearward slope of the front support posts 141 can better absorb forces having a generally rearward vector (with respect to the head) than the generally vertical front support posts 41 of the embodiment shown in FIGS. 1–4. Thus, with protector 111 of FIG. 5, should the user fall and land on the forward part of the head shield 151, as opposed to the top of the head shield 151, more of the rearwardly directed forces will be transferred to the jacket 113, and hence the user's upper torso. This will reduce the possibility of the head shield 151 moving horizontally (with reference to the drawings). The front posts 141 slope forwardly from the shoulder and form an angle a to the vertical of about 15°–25°, and preferably about 20°, as shown in FIG. 5.

Secondly, the rear support posts 43 of FIGS. 1–4 are replaced with a rigid buttress 143 which extends between the head shield 151 and the yoke 135. The yoke 135 is substantially similar to the yoke 35. However, it has been altered such that the buttress 143 is integrally molded or formed with the yoke 135. The buttress 143 is preferably approximately 10 cm wide and extends up to the mounting ring 167 to be secured thereto with, for example, screws 174. The buttress 143 preferably has a curvature which matches the curvature of the mounting ring 167 so that the head shield can be connected to the buttress in more than one location along the buttress.

When wearing the protector 11 or 111 of the present invention, the user is free of the heavy discomfort of a conventional protective head helmet. A cap, however, can be worn for warmth or style. If desired, a plastic windshield extending down over the eyes or the whole face can be hinge-attached to the front of the head shield to protect the user's face from objects and the wind.

The adjustable features of the protector 11 or 111 are designed for efficient custom fitting of the protector to a single individual. Such individualized adjustment ensures that the space 65 between the user's head and the head shield between the head shield and the vest is properly sized. Such a custom fit will take into account height of the user's neck and the size of his or her head. Further, if the angle of the posts relative to the mounting brackets are adjustable, such as with the ball and socket bracket described above and shown in FIG. 8, the angle of the head shield can be adjusted for the specific user, to better account for head shape and size. The angle of the posts can be adjusted to account for the length of the neck, the height of the head, and the posture of the user. This custom fitting of the protector will provide the most protection to specific users. Further, no portion, or only a small amount, of the support posts will extend above the mounting ring.

The protector is preferably light weight, e.g., about 6 to 7 lbs. (about 2.7–3.2 kg). The weight will, of course, be affected by the materials chosen to make the protector 11 or 111 and the size of the protector. The height and angle of the head shield are adjustable and need firing only once with screw clamps. The jacket can be perforated for ventilation.

It can therefore be appreciated that some of the benefits of my protector 11 and 111 are as summarized below:

1. The posts (and buttress) solidly anchor the head shield to provide direct protection to the head and hence the brain. It spares the neck and hence the spinal cord from extreme axial and bending forces.

2. The device is light weight and, when worn, has no moving parts.

3. The subject is free from a tight fitting heavy helmet.

4. The subject has full visual field and voluntary head and neck movement within a safe range.

5. Extreme forces, which might otherwise irreparably injure, or even destroy, the cervical spinal cord, are transmitted to the upper chest structures, muscles, and rib cage where such forces can be more easily tolerated, and where the resulting injuries will be less severe.

6. There are aesthetic and decorative marketing advantages in a device that does not obscure the subject's face and personal identity.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense. For example, although some materials are suggested for the head shield, vest, yoke, and support members (i.e. the posts and buttress), any material can be used which will serve to protect the user, as described. This example is merely illustrative.

I claim:

1. A brain and spinal cord protector for protecting the brain and spinal cord of a user against a fall, the protector comprising:

a base which rests at least partially upon the user's shoulders;

a head shield sized and shaped to substantially cover the user's head, the head shield having an inner surface and an outer surface; and a support extending from said base to said head shield to position said head shield above the base so that the head shield inner surface is spaced from said user's head to allow the user to freely move his head from side to side and up and down relative to the head shield when wearing the head shield, said support being mounted at one end to said base and at a second end to said head shield to substantially prevent movement of said head shield relative to the support.

2. The brain and spinal cord protector of claim 1 wherein said base includes a jacket; said jacket comprising a vest and a yoke; said vest being sized to fit around a user's torso and including connectors for securing the jacket about the user's torso, said vest being made of a sturdy, pliable material; said yoke covering a portion of the user's chest, back, and shoulders, said yoke being made of a material which can withstand impacts and distribute the force of the impact to the user's shoulders and chest.

3. The brain and spinal cord protector of claim 2 wherein the yoke has a front portion, a shoulder portion, and a back portion; said support comprising a back support which extends between a back of said head shield and the back portion of said yoke, and a front support which extends between said head shield and said yoke, said front support being positioned to be rearwardly of said user's eyes.

4. A brain and spinal cord protector for protecting the brain and spinal cord of a user against a fall, the protector comprising:

a jacket for wearing about the user's torso; said jacket comprising a vest and a yoke; said vest being sized to fit around a user's torso and including connectors for securing the jacket about the user's torso, said vest being made of a sturdy, pliable material; said yoke coveting a portion of the user's chest, back, and shoulders, said yoke being made of a material which can withstand impacts and distribute the force of the impact to the user's shoulders and chest; the yoke having a front portion a shoulder portion, and a back portion;

a head shield shaped for coveting the user's head, the head shield having an inner surface and an outer surface; and a support extending from said jacket to said head shield to position said head shield above the jacket so that the head shield inner surface is spaced from said user's head to allow the user to move his head relative to the head shield when wearing the head shield, said support being mounted at one end to said jacket and at a second end to said head shield to substantially prevent movement of said head shield relative to the support; said support comprising a back support which extends between a back of said head shield and the back portion of said yoke, and a front support which extends between said head shield and said yoke, said from support being positioned to be rearwardly of said user's eyes; said front support comprising a pair of front support posts, said front support posts being mounted at one end to said yoke and at another end to said head shield, said jacket including front bosses on said yoke which receive a bottom end of said front support posts, and said head shield including front mounting brackets which receive upper ends of said front support posts.

5. The brain and spinal cord protector of claim 4 wherein said front support posts extend generally vertically between said yoke front portion and said head shield when said user is sitting or standing generally upright, said bosses being positioned on said yoke front portion to be slightly above the user's armpits.

6. The brain and spinal cord protector of claim 4 wherein said front support posts extend downwardly and rearwardly from said head shield to said yoke shoulder portion, said bosses being positioned on said yoke shoulder portion to be generally on top of the user's shoulders.

7. The brain and spinal cord protector of claim 6 wherein the support posts form an angle of between 15° and 25° with the vertical when the user is standing or sitting upright.

8. The brain and spinal cord protector of claim 4 wherein said back support comprises a pair of back support posts, each back support post having a bottom end and an upper end, the back support posts being mounted at one end to said yoke shoulder portion and at another end to said head shield to extend generally vertically when the user is standing or sitting upright, the jacket including a pair of rear bosses on said rear portion of said yoke, each rear boss receiving a bottom end of one of the back support posts, and said head shield including a pair of rear mounting brackets, each bracket receiving an upper end of the rear support posts.

9. The brain and spinal cord protector of claim 8 further comprising a mounting ring which extends around said head shield outer surface, said front and rear mounting brackets being fixed to said mounting ring.

10. A brain and spinal cord protector for protecting the brain and spinal cord of a user against a fall, the protector comprising:

a jacket for wearing about the user's torso, the jacket having a reinforced portion covering at least a portion of the user's chest, back, and shoulders;

a head shield shaped for covering the user's head, the head shield having an inner surface and an outer surface; and a pair of front support posts mounted to said jacket reinforced portion and a rear support mounted to said jacket reinforced portion; said front support posts extending upwardly from a forward portion of said jacket reinforced portion and being operatively connected to a front portion of said head shield; said rear support extending upwardly from a rear portion of said jacket reinforced portion and being operatively connected to a rear portion of said head shield; said front support posts and said rear support positioning said head shield above the vest so that the head shield inner surface is spaced from said user's head to allow the user to move his head relative to the head shield when wearing the head shield, the connection of the head shield to said front and rear supports substantially preventing movement of said head shield relative to said supports.

11. The brain and spinal cord protector of claim 10 wherein said rear support comprises a pair of rear support posts extending upwardly from the a back portion of the vest reinforced area.

12. The brain and spinal cord protector of claim 10 wherein said rear support comprises a buttress extending up from said jacket reinforced portion to be connected to said rear portion of said head shield.

13. The brain and spinal cord protector of claim 10 wherein said jacket comprises a vest and said jacket reinforced portion comprises a yoke fixed to said vest, said yoke being made of a material which can withstand impacts and distribute the force of the impact to the user's shoulder.

14. The brain and spinal cord protector of claim 12 further comprising a mounting ring which extends around said head shield outer surface and front and rear mounting brackets being secured to said mounting ring, said front and rear mounting posts being secured in said front and rear mounting brackets such that said head shield is substantially secured against movement relative to said support posts.

15. The brain and spinal cord protector of claim 14 further comprising from and rear bosses on said jacket reinforced portion, said bosses each having a recess which accepts lower ends of said front and rear support posts, said support posts being fixed in said bosses.

16. The brain and spinal cord protector of claim 15 wherein said front and rear mounting brackets and/or said front and rear bosses comprise a ball rotatably encased in a housing; said housing having top and bottom aligned holes, said ball having a bore therethrough which is alignable with said top and bottom openings of said housing, said ball bore being sized to snugly receive said support posts, said ball being made of a material which will frictionally grip said support posts, said ball being securable in a desired position in said housing.

17. The brain and spinal cord protector of claim 16 wherein said housing includes a screw hole, a set screw passing through said screw hole to compress said ball to secure said ball in said desired position.

18. The brain and spinal cord protector of claim 10 wherein said head shield comprises a shell having an inner and outer surface and a pad affixed to said shell inner surface; said pad having an inner surface, said pad inner surface being spaced from said user's head.

19. The brain and spinal cord protector of claim 10 wherein said head shield inner surface is spaced from about 1 cm to about 3 cm from the user's head.

20. The brain and spinal cord protector of claim 10 wherein in padding is applied to an inner surface of said jacket.

21. The brain and spinal cord protector of claim 20 wherein said padding is removably applied to said jacket inner surface.

22. The brain and spinal cord protector of claim 1 wherein the space is sized to allow for the user to tilt his head rearwardly about 40°, to tilt his head forwardly about 30°, and to turn his head about 70° to each side.

23. The brain and spinal cord protector of claim 22 wherein said head shield inner surface is spaced from about 1 cm to about 3 cm from the user's head.

* * * * *

UNITED STATES PATENT AND TRADEMARK OFFICE

CERTIFICATE OF CORRECTION

PATENT NO. : 5,715,541

DATED : February 10, 1998

INVENTOR(S) : William M. Landau

It is certified that error appears in the above-identified patent and that said Letters Patent is hereby corrected as shown below:

Col. 3, line 34
replace "from"
with --front--.

Col. 3, line 57
replace "from"
with --front--.

Col. 3, line 57
replace "from"
with --front--.

Col. 3, line 61
replace "bail"
with --ball--.

Col. 4, line 53
replace "fight"
with --right--.

Col. 10, line 18
replace "coveting"
with --covering--.

Col. 10, line 37
replace "from"
with --front--.

Col. 12, line 7
replace "from"
with --front--.

Signed and Sealed this

Twenty-ninth Day of September, 1998

*Attest:*

Bruce Lehman

BRUCE LEHMAN

*Attesting Officer*

*Commissioner of Patents and Trademarks*